US008054055B2

(12) United States Patent
Mandal

(10) Patent No.: US 8,054,055 B2
(45) Date of Patent: Nov. 8, 2011

(54) FULLY INTEGRATED ON-CHIP LOW DROPOUT VOLTAGE REGULATOR

(75) Inventor: Sajal Kumar Mandal, Howrah (IN)

(73) Assignee: STMicroelectronics PVT. Ltd., Greater Noida (IN)

( * ) Notice: Subject to any disclaimer, the term of this patent is extended or adjusted under 35 U.S.C. 154(b) by 478 days.

(21) Appl. No.: 12/347,425

(22) Filed: Dec. 31, 2008

(65) Prior Publication Data

US 2009/0128104 A1 May 21, 2009

Related U.S. Application Data

(63) Continuation-in-part of application No. 11/609,676, filed on Dec. 12, 2006, now Pat. No. 7,589,507.

(30) Foreign Application Priority Data

Dec. 30, 2005 (IN) ..... 3532/DEL/2005

(51) Int. Cl.
*G05F 1/56* (2006.01)

(52) U.S. Cl. ..... 323/280; 327/534

(58) Field of Classification Search ..... 323/280, 323/226, 273–279, 281; 327/534, 535, 537
See application file for complete search history.

(56) References Cited

U.S. PATENT DOCUMENTS

| | | | | |
|---|---|---|---|---|
| 6,094,068 | A * | 7/2000 | Nomura et al. | 326/83 |
| 6,188,211 | B1 | 2/2001 | Rincon-Mora et al. | |
| 6,333,623 | B1 | 12/2001 | Heisley et al. | |
| 6,603,292 | B1 | 8/2003 | Schouten et al. | |
| 6,639,390 | B2 * | 10/2003 | Perez et al. | 323/282 |
| 6,654,058 | B1 * | 11/2003 | Hosier et al. | 348/301 |
| 6,690,147 | B2 | 2/2004 | Bonto | |
| 6,700,361 | B2 | 3/2004 | Gregorius | |
| 7,830,203 | B2 * | 11/2010 | Chang et al. | 327/544 |
| 2004/0164789 | A1 | 8/2004 | Leung et al. | |
| 2005/0127885 | A1 | 6/2005 | Jung | |
| 2006/0091955 | A1 * | 5/2006 | Choi | 330/260 |

* cited by examiner

*Primary Examiner* — Harry Behm
(74) *Attorney, Agent, or Firm* — William J. Kubida; Peter J. Meza; Hogan Lovells US LLP

(57) ABSTRACT

A low dropout voltage regulator (LDO) includes a bias voltage generator, a differential error amplifier, an output driver, a controlled active load, a Double Ended Cascode Miller compensation block. The bias voltage generator produces a plurality of bias voltages. The differential error amplifier produces a differential output voltage based on the difference between a reference voltage and a function of the output voltage. The input terminal of the output driver is coupled to one output of the differential error amplifier. The substrate terminal of the output driver is capacitively coupled to the output node and resistively coupled to the input supply node. The controlled active load is coupled to the output of the output driver, and its control terminal is coupled to a function of the second output of the differential error amplifier. The inputs of the Double Ended Cascode Miller compensation block are capacitively coupled to the output node and its output is coupled to the input terminal of the output driver.

9 Claims, 10 Drawing Sheets

FULLY INTEGRATED ON-CHIP LOW DROPOUT VOLTAGE REGULATOR

RELATED APPLICATION

The present application is a continuation-in-part of U.S. patent application Ser. No. 11/609,676 filed Dec. 12, 2006, which claims priority of Indian Patent Application No. 3532/Del/2005 first filed Dec. 30, 2005 as a provisional application, for which a complete specification was filed Aug. 10, 2006, said applications being incorporated herein in their entireties by this reference.

TECHNICAL FIELD

The present disclosure relates to the field of voltage regulators, and more specifically to fully integrated on-chip low dropout voltage regulators.

BACKGROUND

A low dropout regulator (LDO) is a DC linear voltage regulator which can operate with a very small input-output differential voltage. In conventional low dropout voltage regulators i.e. LDOs, it is necessary to couple an off-chip capacitor at the output of the LDO which generates a low frequency dominant pole at the regulated output node in order to obtain stability. The low frequency dominant pole at the output node provides stability while maintaining a good transient response, however the off-chip capacitor increases bill of material and consumes significant board area.

Current trends in technology demand miniaturization of electronic devices and thus the off-chip capacitor in a conventional LDO needs to be eliminated. The dominant pole may still be implemented on the regulated output node by replacing the off-chip capacitor by an on-chip one, however such a dominant pole varies widely with the load current due to small value of on-chip capacitance available thus rendering it ineffective for certain loads. Alternatively, when the dominant pole is realized on an internal node the slew rate is degraded resulting in a slower transient response.

FIG. 1 illustrates the ripple response of a conventional LDO for a load that generates a train of spike currents such as a clock tree network. FIG. 1(*a*) shows the block diagram of the conventional LDO while FIG. 1(*b*) shows the train of spike currents and corresponding ripple in the output voltage at each clock edge. The maximum peak current ($I_P$) occurs at the rising edge of the clock when inverters at the final stage of the clock tree charge their load capacitances. On the falling edge of the clock, the peak current drawn from the supply is reduced by a value equivalent to the stage ratio in the clock tree ($I_P$/N). This is due to the reduction of the number of clock tree inverters charging their load capacitances on this edge of the clock by a value equivalent to the stage ratio.

FIG. 2 illustrates a conventional technique to evaluate the transient response of the low dropout voltage regulator (LDO) for a step change in the load current. The response time ($T_R$) is defined as the minimum time required by the LDO to attain a required output current after the application of the load. Simulation of LDO's response with load transient stimuli both in the form of a train of current spikes and step change in the load current enables the evaluation of the total transient variation on the regulated output voltage of LDO. The ripple response of LDO with a train of spike current is crucial to estimate jitter in the clock when the clock tree is optimized for minimum clock skew. On the other hand, a step change, which occurs when the clock signal suddenly starts (or stops) to propagate down the clock tree, alters the average consumption from low (or high) to a high (or low) value during the propagation delay period in the clock tree.

SUMMARY OF THE INVENTION

An embodiment of a low dropout voltage regulator (LDO) of the present invention preferably includes a bias voltage generator for producing one or more bias voltages, a differential error amplifier having one input for receiving a reference voltage and a second input for receiving a function of the output voltage and producing a differential output voltage, an output Driver having its input coupled to a first output of the error amplifier and its output terminal providing the output voltage with its substrate terminal capacitively coupled to the output node and resistively coupled to the input supply node, a controlled active load coupled to the output node and having its control terminal coupled to a function of the second output of said error amplifier, and a Double Ended Cascode Miller compensation block having both inputs individually capacitively coupled to the output node and its output coupled to the input of said output Driver.

BRIEF DESCRIPTION OF DRAWINGS

The disclosure is illustrated with the help of the accompanying drawings where.

DETAILED DESCRIPTION

Figure 1:
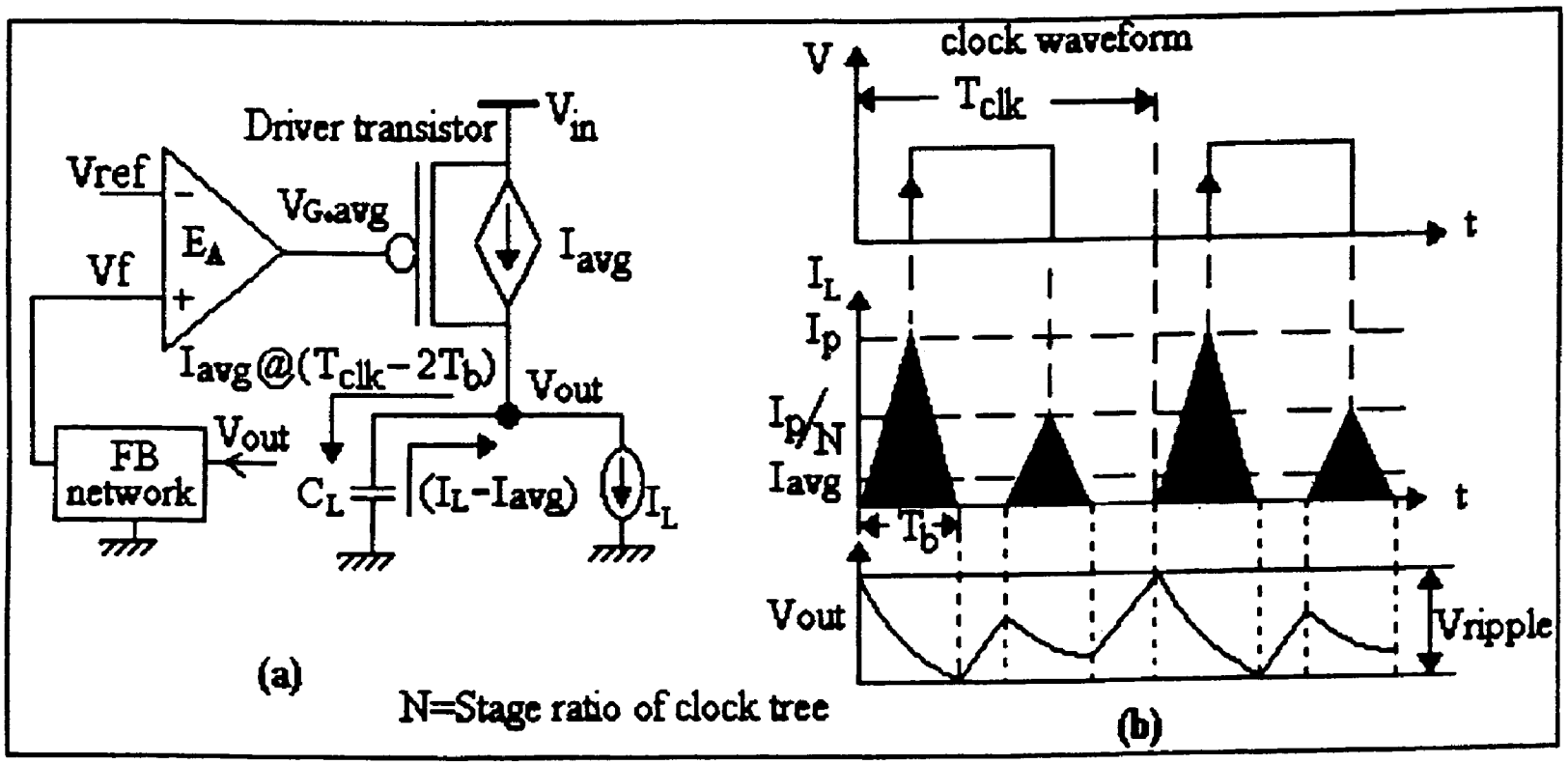
FIG. 1 illustrates the ripple response and the various current components of a conventional low dropout voltage regulator (LDO) in the case of a train of spike currents in the load.
Figure 2:
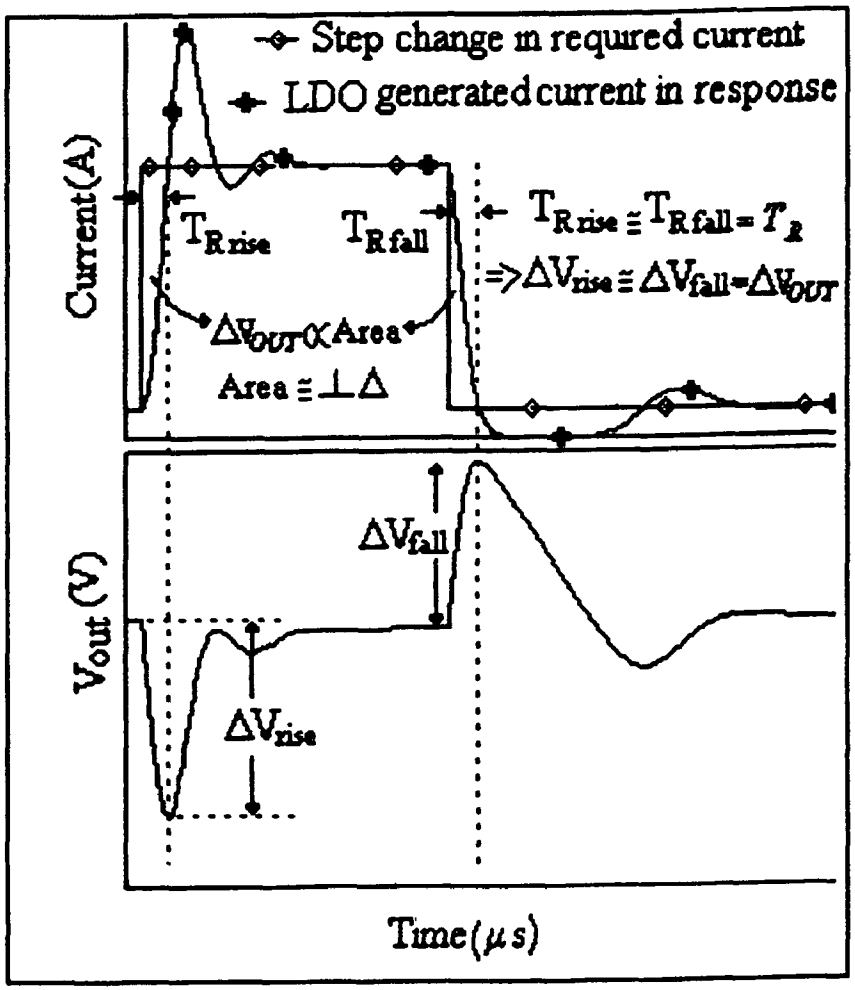
FIG. 2 illustrates the conventional response of the LDO due an instantaneous step change in the load current and its dependence on the response time ($T_R$) of the LDO.

Some embodiments of the present disclosure are described in detail with reference to the accompanying drawings. However, the disclosure is not limited to these embodiments which are only provided to aid the understanding to the ordinarily skilled in the relevant art. In the accompanying drawings, like reference numerals are used to indicate like components.

Figure 3:
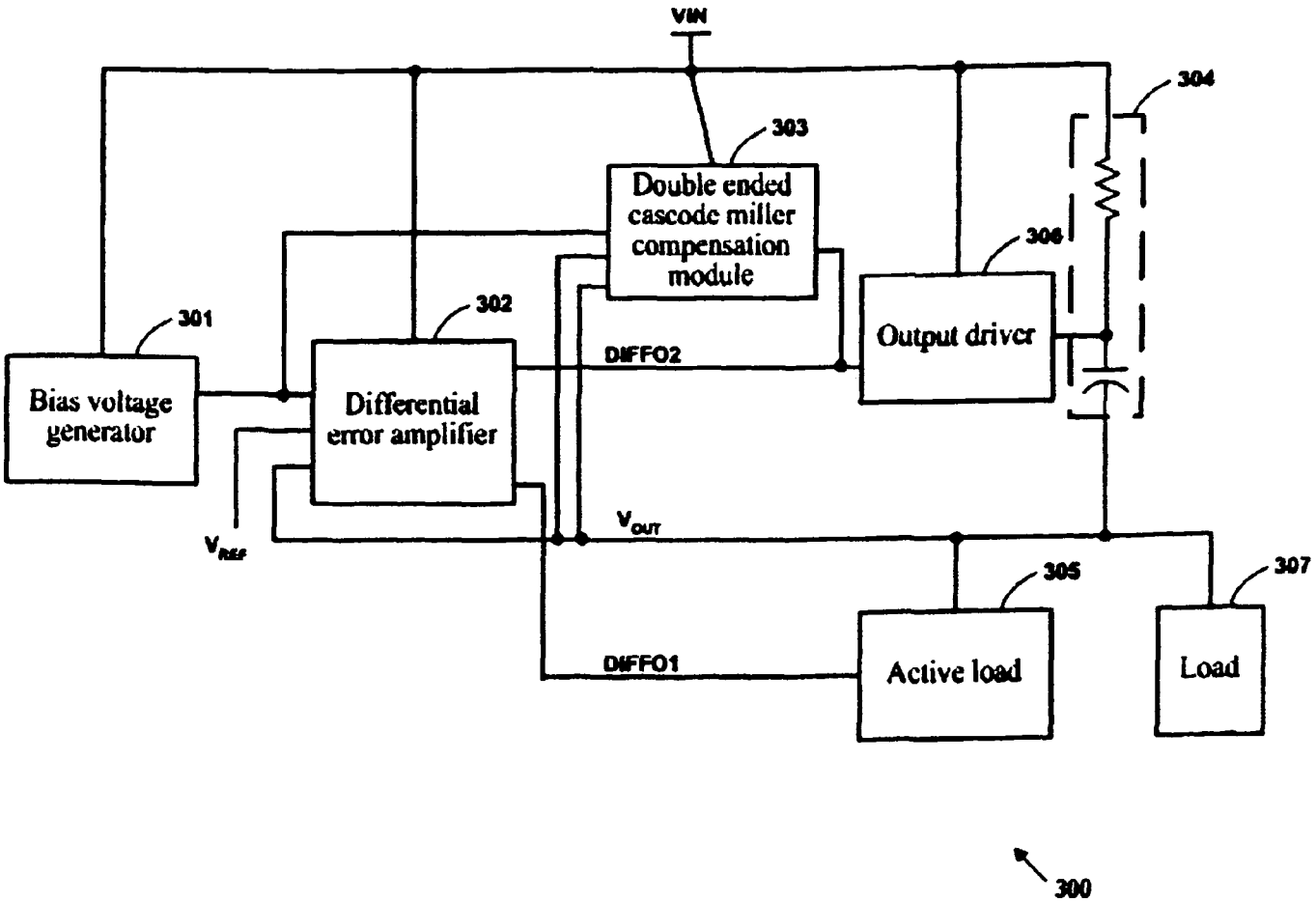
FIG. 3 illustrates the block diagram of an LDO according to an embodiment of the present disclosure.

The present disclosure teaches a fully integrated on-chip low dropout voltage regulator (LDO) that provides stability over a large range of values of on-chip capacitance and undegraded transient response under all expected load conditions without the need for any off-chip capacitor. The LDO comprises a bias voltage generator, a differential error amplifier, an output driver and a quiescent load as in the conventional art. However, unlike in the conventional art where the quiescent load is provided by a fixed resistor, the active load in the present disclosure is controlled by a function of an output taken from the differential error amplifier which is complementary to the output that drives the output driver. Secondly, a Double Ended Cascode Miller compensation block having its inputs coupled to the regulated output node generates a dominant pole and provides additional drive to the output driver whenever there is a transient variation in regulated output. Finally, the substrate of the output driver is not directly tied to the input voltage as in the conventional art, but is instead capacitively coupled to the output node and resistively tied to the input voltage. The combination of improvements taught by this disclosure acts to provide both stability and improved transient response, without the need for any off-chip capacitor FIG. 3 illustrates the conceptual block diagram of a low dropout voltage regulator (LDO) 300 according to an embodiment of the present disclosure. Bias voltage generator 301, provides various bias voltages required by the other blocks. Differential error amplifier 302 compares output voltage $V_{OUT}$ which it receives at one input with a reference voltage $V_{REF}$ received at its other input, and generates complementary outputs DIFFO1 and DIFFO2 based on the difference between $V_{OUT}$ and $V_{REF}$. Output DIFFO2 drives Output Driver 306 while complementary output DIFFO1 drives Active Load 305. Double Ended Cascode Miller compensation block 403 has both its inputs capacitively coupled to $V_{OUT}$ and its output drives Output Driver 306. The substrate of Output Driver 306 is capacitively coupled to $V_{OUT}$ and biased to the input voltage $V_{IN}$.

Figure 4:
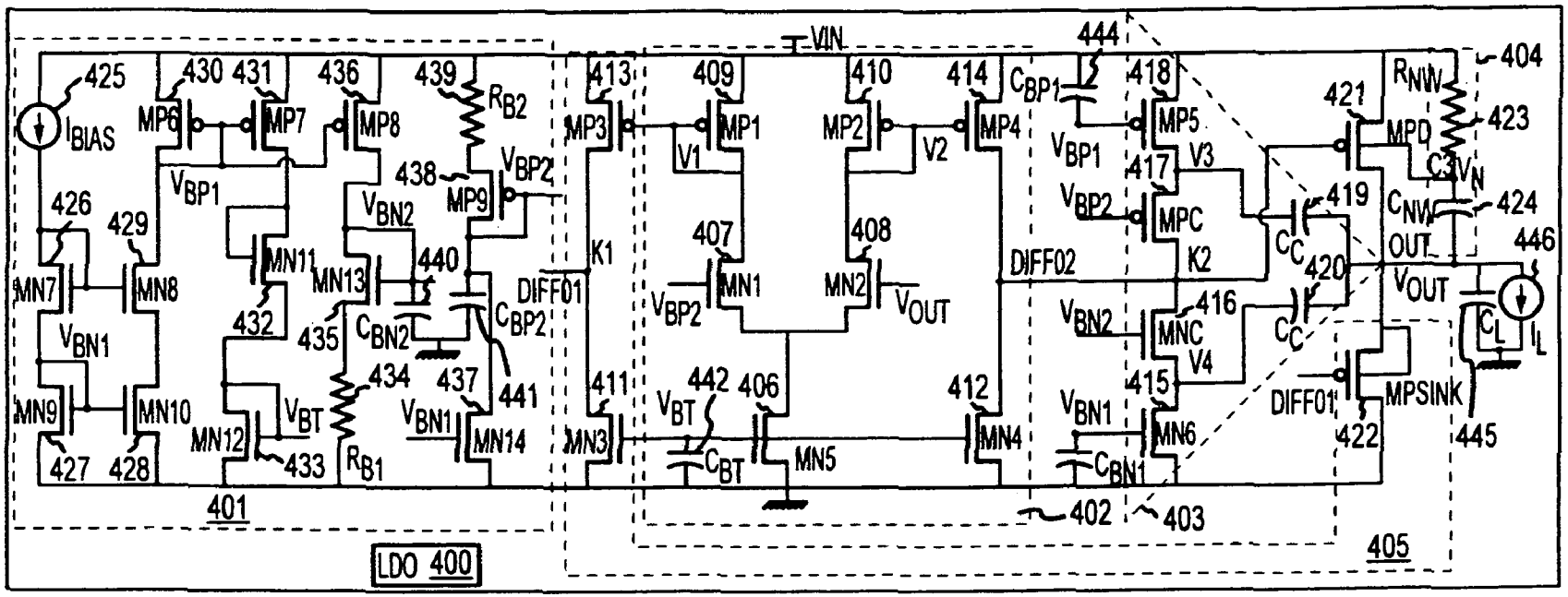
FIG. 4 illustrates the schematic diagram of the on-chip LDO according to an embodiment of the present disclosure.

FIG. 4 shows schematic diagram of the on-chip low dropout voltage regulator (LDO) according to the embodiment of FIG. 3. Bias voltage generator 401 comprises a bias current generator 425, generating a bias current $I_{BIAS}$, which is coupled between the unregulated input power supply $V_{IN}$ and a current mirror comprising transistors 426, 429, 427 and 428. Bias voltage $V_{BN1}$ is generated by a diode-connected transistor 427 and is provided as a gate bias to transistors 437 and 415. Transistor 429 draws a reflected bias current from a diode-connected transistor 430 and produces a bias voltage $V_{PB1}$, which is supplied as a gate bias to transistors 418, 431 and 436. Transistor 431 provides the reflected bias current to diode connected transistors 432 and 433. Diode connected transistor 433 produces a bias voltage $V_{BT}$ which is supplied as a gate bias to transistors 411, 412 and 406. Transistor 436 supplies a reflected bias current to a transistor 435 and a resistor 434 to produce a bias voltage $V_{BN2}$ which is supplied as a gate bias to a transistor 416. Transistor 437 sinks the reflected bias current from a transistor 438 and a resistor 439 to produce the bias voltage $V_{PB2}$, which is supplied as a gate voltage to transistor 417. Capacitors 443, 444, 440, 441 and 442 act as decoupling capacitors for the bias voltages $V_{BN1}$, $V_{BP1}$, $V_{BN2}$, $V_{BP2}$ and the tail bias $V_{BT}$. Differential Error amplifier 402 comprises transistor 406, which sinks the current from the input transistors 407 and 408 while input transistors 407 and 408 compare a reference voltage $V_{REF}$ with output voltage $V_{OUT}$ coupled at their gate terminals, respectively. Transistors 409 and 410 act as diode connected loads to the differential pair and produce voltages $V_1$ and $V_2$. Transistors 414 and 412 receive $V_2$ and $V_{BT}$ at their gate terminals, respectively and produce output voltage $V_{DIFFO2}$ which drives the gate of Output Driver 421 to modulate current through it and compensate for any deviation in the regulated output voltage $V_{OUT}$. Double Ended Cascode Miller compensation block 403 comprises transistors 418, 417, 416, 415 and coupling capacitors 419 and 420 which couple the regulated output voltage $V_{OUT}$ to node voltages $V_3$ and $V_4$ to produce a compensating voltage at the gate of the Output Driver 421 in response to a transient change in the regulated output voltage $V_{OUT}$.

The substrate of Output Driver 421 is biased to the unregulated input supply $V_{IN}$ through resistance 423 and is directly coupled with the regulated output voltage $V_{OUT}$ through coupling capacitor 424. Any transient change in $V_{OUT}$ changes the substrate-source voltage of the Output Driver 421, which modulates its threshold voltage and modifies its current to counteract the change in $V_{OUT}$.

Controlled active load 405 comprises transistors 413, 411 and sink transistor 422 where transistors 413 and 411 receive voltages $V_1$ and $V_{BT}$ at their gate terminals respectively, and produce $V_{DIFFO1}$ at node K1 to modify the gate voltage of sink transistor 422. As load current $I_L$ 446 decreases, the decrease in voltage at node K1 causes sink transistor 422 to sink more current at no load ($I_L$=0) and bleed away the leakage current of the large Output Driver 421 and hence enhances the load regulation. At higher load current ($I_L$>0), the current through sink transistor 422 reduces, which diminishes quiescent current consumption. Sink transistor 422 also helps in reducing the impedance of the output node at small load current and hence improves the transient response.

Figure 5:
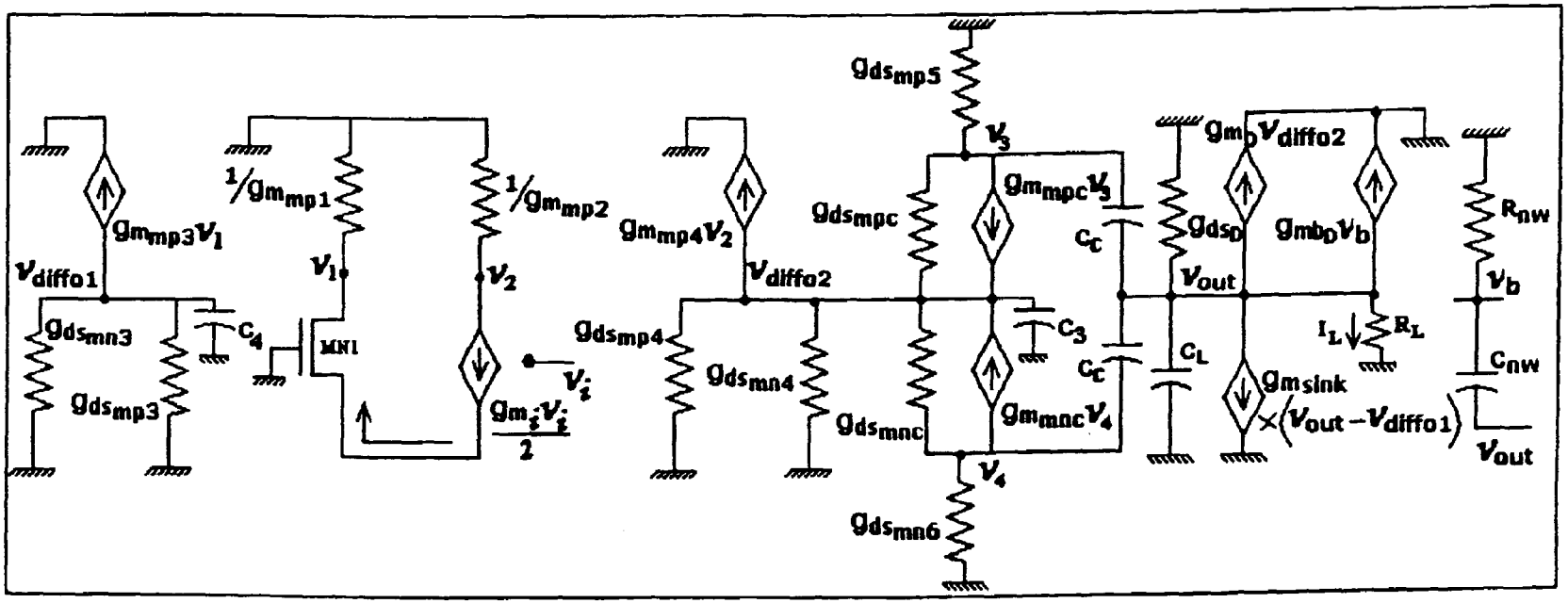
FIG. 5 illustrates the small signal model of the LDO according to an embodiment of the present disclosure.

Small Signal AC Stability Analysis:

FIG. 5 illustrates the small signal equivalent circuit model of the embodiment described in FIG. 4. The loop transfer function from the gate terminal of transistor 408 to the output terminal $V_{OUT}$ is approximated by the following equation:

$$\frac{Vout(S)}{Vin(s)} = A_V\Big|_{DC} \times \frac{\left(1+\frac{S}{Z_1}\right)\left(1+\frac{S}{Z_2}\right)\left(1+\frac{S}{Z_3}\right)}{1+\frac{1}{K}\times[S(N_1)+S^2(N_2)+S^3(N_3)+S^4(N_4)+S^5(N_5)]} \tag{1}$$

where:

$$K=g_O gm_{mnc} gm_{mpc} g_1 g_{11} \tag{1.1}$$

$A_v|_{DC}$ is the DC loop gain and approximated by $$A_V|_{DC} = -\frac{1.25\ gm_i}{(gds_{mn4}+gds_{mp4})} \times \frac{(gm_D+gm_{sink})}{(gds_D+gm_{sink})} \tag{2}$$

The DC loop gain initially increases with the load current as the increase in ($gm_D$+$gm_{sin\ k}$) is greater than the corresponding increase of ($gds_D$+$gm_{sin\ k}$) with the load current. This results in an improved load regulation. At higher load currents when $gm_D \gg gm_{sin\ k}$ and $gds_D \gg gm_{sin\ k}$, the DC open loop gain decreases with load current and is given by:

$$A_v|_{DC} = -\frac{1.25\ gm_i}{(gds_{mn4}+gds_{mp4})} \times \frac{gm_D}{gds_D} \tag{2.1}$$

$$N_1 = \begin{bmatrix} C_O gm_{mnc} gm_{mpc} g_1 g_{11} + C_3 g_o gm_{mnc} gm_{mpc} g_{11} + \\ C_4 g_O gm_{mnc} gm_{mpc} g_1 + C_C g_O g_C g_1 g_{11} + \\ 2C_C gm_D gm_{mnc} gm_{mpc} g_{11} \end{bmatrix} \tag{3}$$

-continued $$N_2 = \begin{bmatrix} C_C^2 g_O g_I g_{II} + C_C C_4 g_O g_C g_I + C_C C_3 g_O g_C g_{II} + \\ C_C C_O g_C g_I g_{II} + C_3 C_4 g_O gm_{mnc} gm_{mpc} + \\ C_O C_4 gm_{mnc} gm_{mpc} g_I + C_3 C_O gm_{mnc} gm_{mpc} g_{II} + \\ C_C^2 gm_D g_C g_{II} + 2C_C C_4 gm_D gm_{mnc} gm_{mpc} - C_C^2 g_C g_I g_{II} \end{bmatrix} \quad (4)$$

$$N_3 = \begin{bmatrix} C_O C_3 C_4 gm_{mnc} gm_{mpc} + C_O C_3 C_C g_C g_{II} + \\ C_O C_4 C_C g_I + C_4 C_C^2 g_O g_I + C_3 C_C^2 g_O g_{II} + C_O C_C^2 g_I g_{II} + \\ C_3 C_4 C_C g_O g_C + C_C^2 C_4 gm_D g_C - C_C^2 C_4 g_C g_I - \\ C_C^2 C_3 g_C g_{II} - 2C_C^3 g_I g_{II} \end{bmatrix} \quad (5)$$

$$N_4 = \begin{bmatrix} C_O C_3 C_4 C_C g_C + C_O C_4 C_C^2 g_I + C_3 C_4 C_C^2 g_O + \\ C_O C_3 C_C^2 g_{II} - 2C_3 C_C^3 g_{II} - 2C_4 C_C^3 g_I - C_3 C_4 C_C^2 g_C \end{bmatrix} \quad (6)$$

$$N_5 = \lfloor C_O C_3 C_4 C_C^2 - 2C_3 C_4 C_C^3 \rfloor = C_3 C_4 C_C^2 (C_O - 2C_C) = C_3 C_4 C_C^2 C_L \quad (7)$$

where $C_O=(C_L+2C_C)$, $g_C=(gm_{mnc}+gm_{mpc})$, $g_1=(gds_{mn4}+gds_{mp4})$, $g_{11}=(gds_{mn3}+gds_{mp3})$ and $g_O=(gds_D+gm_{sin\ k})$.

$gm_1$, $gm_{sin\ k}$, $gm_{mnc}$, $gm_{mpc}$, $gm_D$ in the above expression are the transconductances of transistors 408 (or 407), 422, 416, 417 and 421, respectively and $gds_D$, $gds_{mn3}$, $gds_{mp3}$ $gds_{mn4}$, $gds_{mp4}$ are the output conductance of transistors 421, 411, 413, 412 and 414, respectively. $C_C$ 419, 420 refer to the compensation capacitor while C, 445 is the load capacitance the LDO drives.

In case the poles are real and well separated, the transfer function is approximately defined as:

$$H(S) = G \times \frac{\left(1+\frac{S}{Z_1}\right)\left(1+\frac{S}{Z_2}\right)\left(1+\frac{S}{Z_3}\right)}{\left(1+\frac{S}{P_1}\right)\left(1+\frac{S}{P_2}\right)\left(1+\frac{S}{P_3}\right)\left(1+\frac{S}{P_4}\right)\left(1+\frac{S}{P_5}\right)} \cong G \times \frac{\left(1+\frac{S}{Z_1}\right)\left(1+\frac{S}{Z_2}\right)\left(1+\frac{S}{Z_3}\right)}{1+\frac{S}{P_1}+\frac{S^2}{P_1P_2}+\frac{S^3}{P_1P_2P_3}+\frac{S^4}{P_1P_2P_3P_4}+\frac{S^5}{P_1P_2P_3P_4P_5}} \quad (8)$$

The evaluation of poles and zeroes of the LDO is accomplished on comparison of equations 1 and 8. The positions of the poles and zeros change with the load current $I_L$ 446 and the load capacitor $C_L$ 445. The pole zero locations corresponding to the minimum stability margin occur at no load current and maximum load capacitance and have been illustrated in the following description. The stability for other cases are also analyzed through simulated bode plots.

The first pole is located on the DIFFO2 node due to Miller multiplication of the compensation capacitor $C_C$ (419 & 420) across the driver gain stage. It is evaluated by comparing the coefficient of S in the denominator of equations 1 and 8 and is approximately $$P_1 = \frac{K}{N_1} \quad (9)$$

By selecting the dominant parts of $N_1$ from equation 3, the expression for the first pole is given by the following expression:

$$P_1 = -\frac{g_O gm_{mnc} gm_{mpc} g_I g_{II}}{C_O gm_{mnc} gm_{mpc} g_I g_{II} + C_3 g_O gm_{mnc} gm_{mpc} g_{II} + 2C_C gm_D gm_{mnc} gm_{mpc} g_{II}} = -\frac{g_I g_O}{C_O g_I + C_3 g_O + 2C_C gm_D} \quad (9.1)$$

The regulator is stable below a maximum value of the load capacitance $C_L$(445), which is evaluated subsequently. When the load capacitance is limited such that $(C_O g_1) \gg (2\ C_C gm_D)$, the dominant pole from equation 9.1 is obtained as below:

$$P_1 \cong -\frac{g_I g_O}{2C_C gm_D} = -\frac{(gds_{mn4}+gds_{mp4})}{2C_C\left(\frac{gm_D}{(gds_D+gm_{sink})}\right)} = -\frac{(gds_{mn4}+gds_{mp4})}{2C_C \times A_D} \quad (9.2)$$

$A_D$ in equations 9.1 & 9.2 is the gain of the driver stage MPD given by:

$$A_D = \frac{gm_D}{(gds_D + gm_{sink})} \quad (10)$$

Equation 9.2 is similar to simple Miller compensation utilizing a $(2\times C_C)$ capacitor across the driver gain stage MPD (421). The driver gain $A_D$ in equation 10 initially increases with the load current due to the presence of the $gm_{sink}$ factor in the denominator and then reduces subsequently. The first pole frequency increases and loop gain decreases when $gds_D \gg gm_{sin\ k}$ beyond a load current value and thus unity gain frequency remains relatively unaffected.

In an example of the present embodiment, it is assumed that the single pole ($P_1$) occurs within the gain cross over frequency (GCF). The GCF is approximated by multiplying the equations 2 and 9.2 as follows $$f_{GB} \cong \frac{1.25\ gm_i(gm_D + gm_{sink})}{2C_C gm_D} \quad (11)$$

The presence of the $gm_{sin\ k}$ in the numerator of equation 11, which increases with decreasing load current, provides the increased gain-cross-over frequency (GCF) at no load condition thereby producing a good transient response at the lower load current range. At higher load currents when $gm_D \gg gm_{sin\ k}$, the gain-cross-over frequency (GCF) becomes independent of the load current and is approximately defined from the equation 11 as follows $$f_{GB} \cong \frac{1.25 gm_i}{2C_C} \quad (12)$$

The second pole of the LDO located at the output node $V_{OUT}$ (node OUT) and is evaluated by dividing $N_1$ with $N_2$ and approximated by equations 3 and 4, respectively $$P_2 = -\frac{N_1}{N_2} \quad (13)$$

By selecting the dominant parts of $N_1$ and $N_2$ from the equations 3 and 4, the second pole frequency is represented as $$P_2 \cong -\frac{C_O gm_{mnc} gm_{mpc} g_1 g_{11} + C_3 g_O gm_{mnc} gm_{mpc} g_{11} + 2C_C gm_D gm_{mnc} gm_{mpc} g_{11}}{C_C C_O g_C g_1 g_{11} + C_3 C_O gm_{mnc} gm_{mpc} g_{11} + C_C^2 gm_D g_C g_{11} + 2C_C C_4 gm_D gm_{mnc} gm_{mpc}} \quad (13.1)$$

At the high load capacitance, $C_3 C_O gm_{mnc}$, $gm_{mpc}$, $g_{11}$ term dominates in the denominator of the equation 13.1 and hence the second pole is approximately defined as follows $$P_2 \cong -\frac{2C_C gm_D gm_{mnc} gm_{mpc} g_{11}}{C_3 C_O gm_{mnc} gm_{mpc} g_{11}} = -\frac{2C_C}{C_3} \times \frac{gm_D}{C_O} \quad (13.2)$$

No right half plane zero is created due to $C_C$ (419 & 420) as the Double Ended Cascode Miller compensation circuit (403) in the present disclosure provides no feed forward signal path through $C_C$ to the output. Though a high frequency right half plane zero is obtained due to the small gate-drain capacitance of the driver transistor, it does not affect the stability margin as it is located at a frequency much above the unity gain frequency.

Sink transistor MPSINK (422) is introduced in the present disclosure to generate a left half plane zero in the loop transfer function. The left half plane zero in the loop transfer function is created due to two signal paths to the output node OUT—one through the driver transistor MPD (421) and another through sink transistor MPSFNK (422) as shown in FIG. 4. At small load current, the zero frequency is approximately defined by $$Z_1 \cong -\frac{gm_D}{gm_{sin\ k}} \times \left(\frac{g_1}{C_3}\right) \quad (14)$$

Stability margin achieved at no load current and high load capacitance corresponds to minimum stability margin case with P2 and $Z_1$ approximately as defined in equations 13.2 and 14, respectively and are placed close to each other for a pole-zero cancellation. When $P_2$ and $Z_1$ reside within a half decade of frequency of each other, a phase margin above 45° is assured and the corresponding condition is evaluated and approximated as follows $$\frac{g_1}{gm_{sin\ k}} \cong \frac{10C_C}{C_O} \cong \frac{10C_C}{C_L} \text{ as } C_O = (C_L + 2C_C) \text{ and } C_L \gg C_C \quad (15)$$

The maximum value of the on-chip load capacitor $C_L$ (445) for stable operation of the LDO is evaluated by equation 15. In the example embodiment $gm_{sin\ k}$ is approximately two orders higher than $g_1$ making it possible to compensate the load capacitance $C_L$ (445) three orders higher than the compensation capacitor $C_C$ (419 and 420). A compensation capacitor $C_C$ value of 10 pF allows a maximum load capacitor $C_L$ (445) of 10 nF.

The third pole of the LDO is generated due to the Double Ended Cascode Miller compensation circuit (403) and is evaluated by dividing $N_2$ with $N_3$ defined by the equations 4 and 5, respectively $$P_3 = -\frac{N_2}{N_3} \quad (16)$$

By selecting the dominant parts of $N_2$ and $N_3$ from the equations 4 and 5, the third pole frequency is represented as $$P_3 \cong -\frac{C_C C_O g_C g_1 g_{11} + C_3 C_O gm_{mnc} gm_{mpc} g_{11} + C_C^2 gm_D g_C g_{11} + 2C_C C_4 gm_D gm_{mnc} gm_{mpc}}{C_O C_3 C_4 gm_{mnc} gm_{mpc} + C_O C_3 C_C g_C g_{11} + C_C^2 C_4 gm_D g_C} \quad (16.1)$$

At considerable load capacitance the second term in the numerator and the denominator becomes dominant and equation 16.1 may be approximated as follows $$P_3 \cong -\frac{C_3 C_O gm_{mnc} gm_{mpc} g_{11}}{C_O C_3 C_C g_C g_{11}} = -\frac{gm_{mnc} \| gm_{mpc}}{C_C} \quad (16.2)$$

Second and third zeroes of the loop transfer function are generated from the Double Ended Cascode Miller compensation circuit (403) and are approximately defined by $$Z_2 = -\frac{gm_{mpc}}{C_c} \cong 2 \times P_3 \text{ as } gm_{mnc} \cong gm_{mpc} \quad (17)$$

$$Z_3 = -\frac{gm_{mnc}}{C_C} \quad (18)$$

In an example of the present embodiment of the disclosure $P_3$ occurs after UGC. From equation 17, $Z_2$ and $Z_3$ are computed as one octave beyond $P_3$.

The fourth pole of the LDO is generated on the node DIFFO1 (node K1) and evaluated by dividing $N_3$ with $N_4$ and approximately defined by equations 5 and 6, respectively $$P_4 = -\frac{N_3}{N_4} \quad (19)$$

By selecting the dominant parts of $N_3$ and $N_4$ from equations 5 and 6, the fourth pole frequency is represented as $$P_4 = -\frac{C_O C_3 C_4 gm_{mnc} gm_{mpc} + C_O C_3 C_C g_C g_C g_{11} + C_C^2 C_4 gm_D g_C}{C_O C_3 C_4 C_C g_C + C_O C_4 C_C^2 g_1 + C_3 C_4 C_C^2 g_O + C_O C_3 C_C^2 g_{11}} \quad (19.1)$$

At a load capacitance sufficient to neglect other terms with respect to the second and first terms in equation 19.1, $P_4$ is approximated as follows $$P_4 \cong -\frac{C_O C_3 C_C g_C g_{11}}{C_O C_3 C_4 C_C g_C} = -\frac{g_{11}}{C_4} \quad (19.2)$$

A fifth pole of the LDO is generated from the Double Ended Cascode Miller compensation circuit (403) and is evaluated by dividing $N_4$ with $N_5$ $$P_5 = -\frac{N_4}{N_5} \quad (20)$$

By selecting the dominant parts of $N_4$ from equation 6, the fifth pole frequency is represented as $$P_5 = -\frac{C_O C_3 C_4 C_C g_C + C_O C_4 C_C^2 g_I + C_3 C_4 C_C^2 g_O + C_O C_3 C_C^2 g_{II}}{C_3 C_4 C_C^2 C_L} \quad (20.1)$$

$$P_5 \cong -\frac{C_O C_3 C_4 C_C g_C + C_O C_3 C_C^2 g_{II}}{C_3 C_4 C_C^3 C_L} = -\left(1 + \frac{2C_C}{C_L}\right) \times \left(\frac{g_C}{C_C} + \frac{g_{II}}{C_4}\right) \cong -\left(\frac{g_C}{C_C}\right) = -\frac{gm_{mnc} + gm_{mpc}}{C_C} \cong 2 \times Z_3$$

Comparing equations 20.1 with 17 and 18, we observe that $P_5$ is computed to be one octave beyond $Z_2$ and $Z_3$, and $P_4$ is computed as between $Z_2$ (or $Z_3$) and $P_5$.

Figure 6:
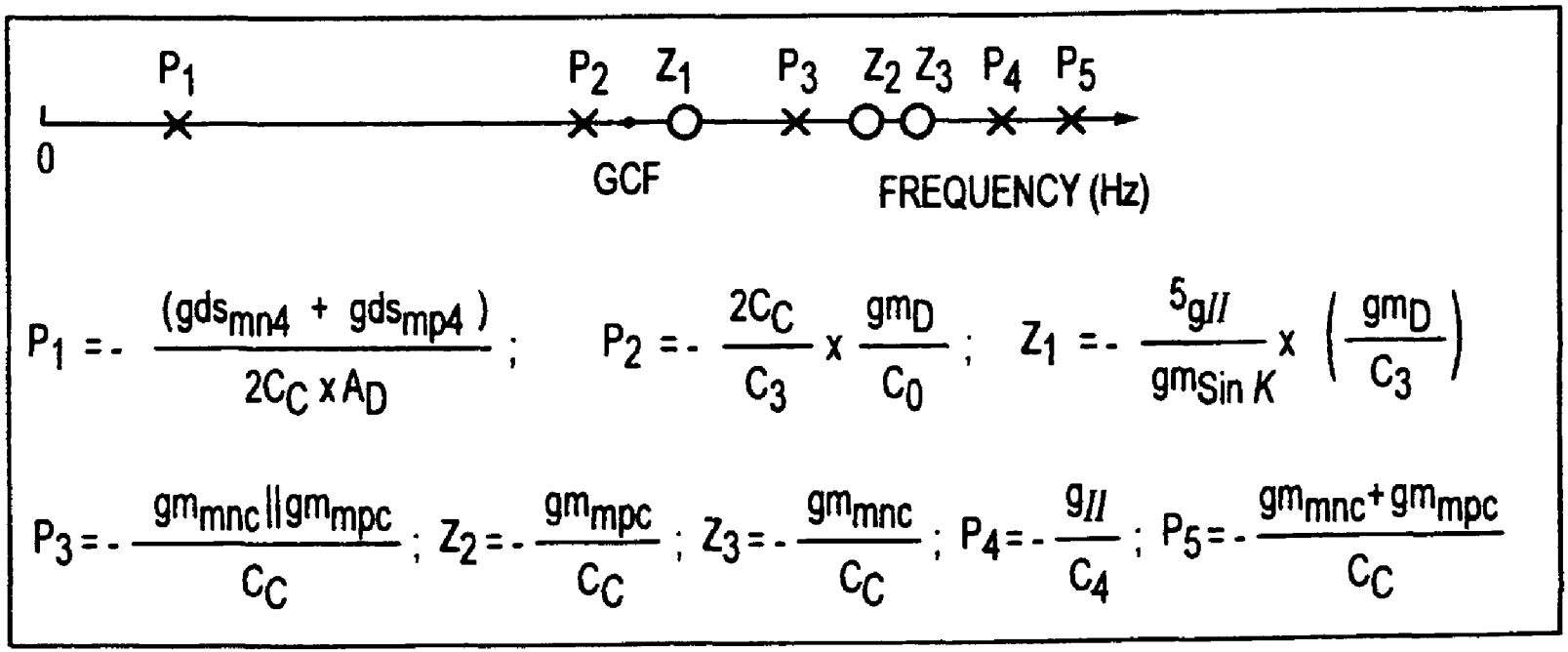
FIG. 6 illustrates the worst case of the pole-zero location of an embodiment of the present disclosure.

Example of Embodiments in Small Signal AC Stability Analysis According to the Present Disclosure:

FIG. 6 illustrates the worst case of pole-zero locations where an LDO in accordance to the present embodiment of the disclosure has sufficient stability margin if $P_2$ is not pushed deep within the UGC at no load and high load capacitance. The corresponding maximum value of load capacitance is evaluated in equation 15. Therefore, the LDO in accordance to the present embodiment has five poles and three zeros and, after pole-zero cancellation is effectively a two pole system. The pole-zeroes relocate themselves depending on the load current and the load capacitance, and stability is confirmed through simulated bode plots as described below.

Small Load Capacitor Case:

Case 1: $C_L$=100 pF, $I_L$=0

Case2: $C_L$=100 pF, $I_L$=50 mA

Case 3: $C_L$=100 pF, $I_L$=100 mA

Figure 7:
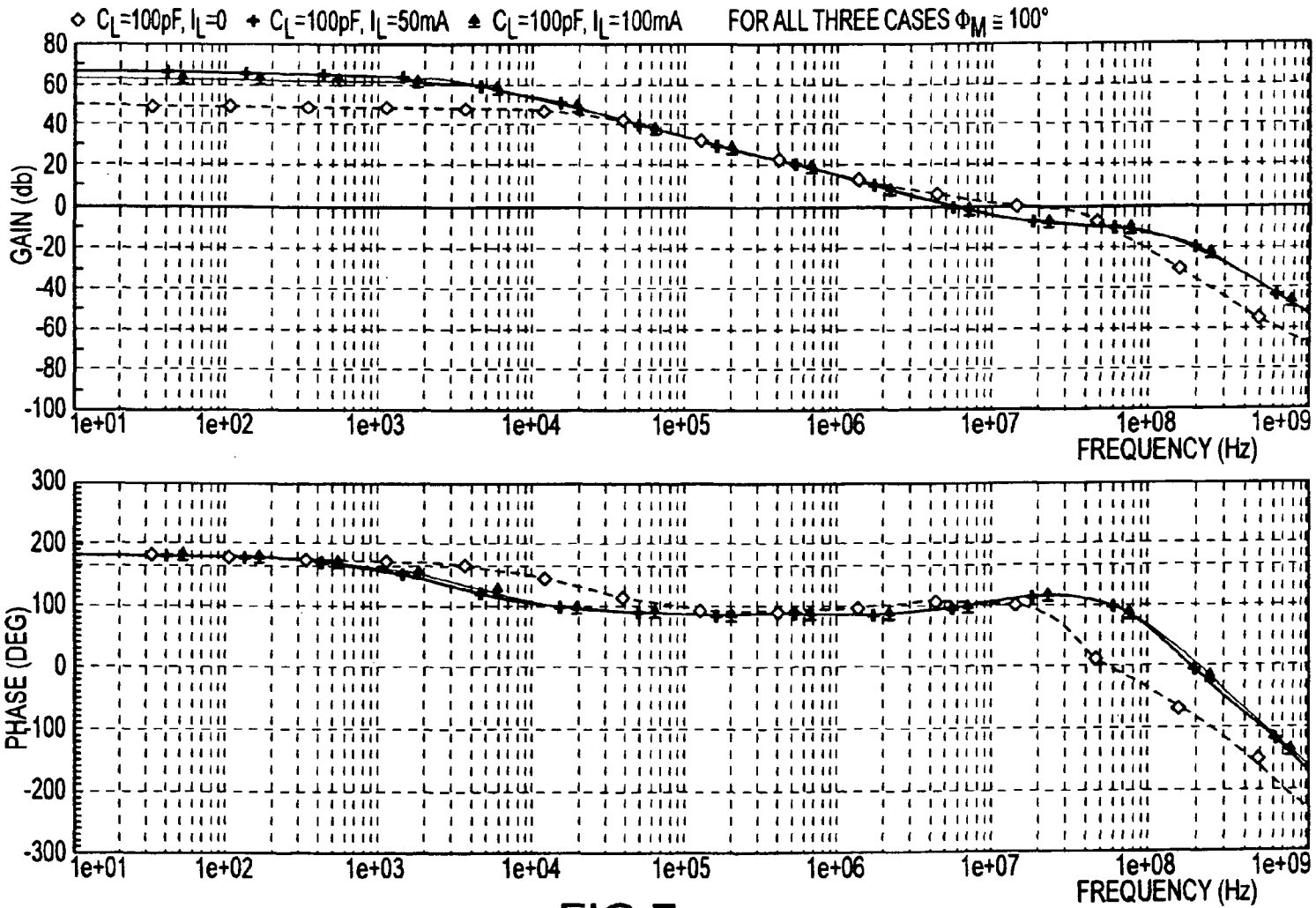
FIG. 7 illustrates the simulated Bode plot of an example LDO according to an embodiment of the present disclosure for a load capacitance of 100 pF.

The simulated bode plots corresponding to the above three cases are shown in FIG. 7 where phase margin is approximately 100°.

High Load Capacitance Case.

Case 4: $C_L$=10 nF, $I_L$=0

Case 5: $C_L$=10 nF, $I_L$=50 mA

Case 6: $C_L$=10 nF, $I_L$=100 mA

Figure 8:
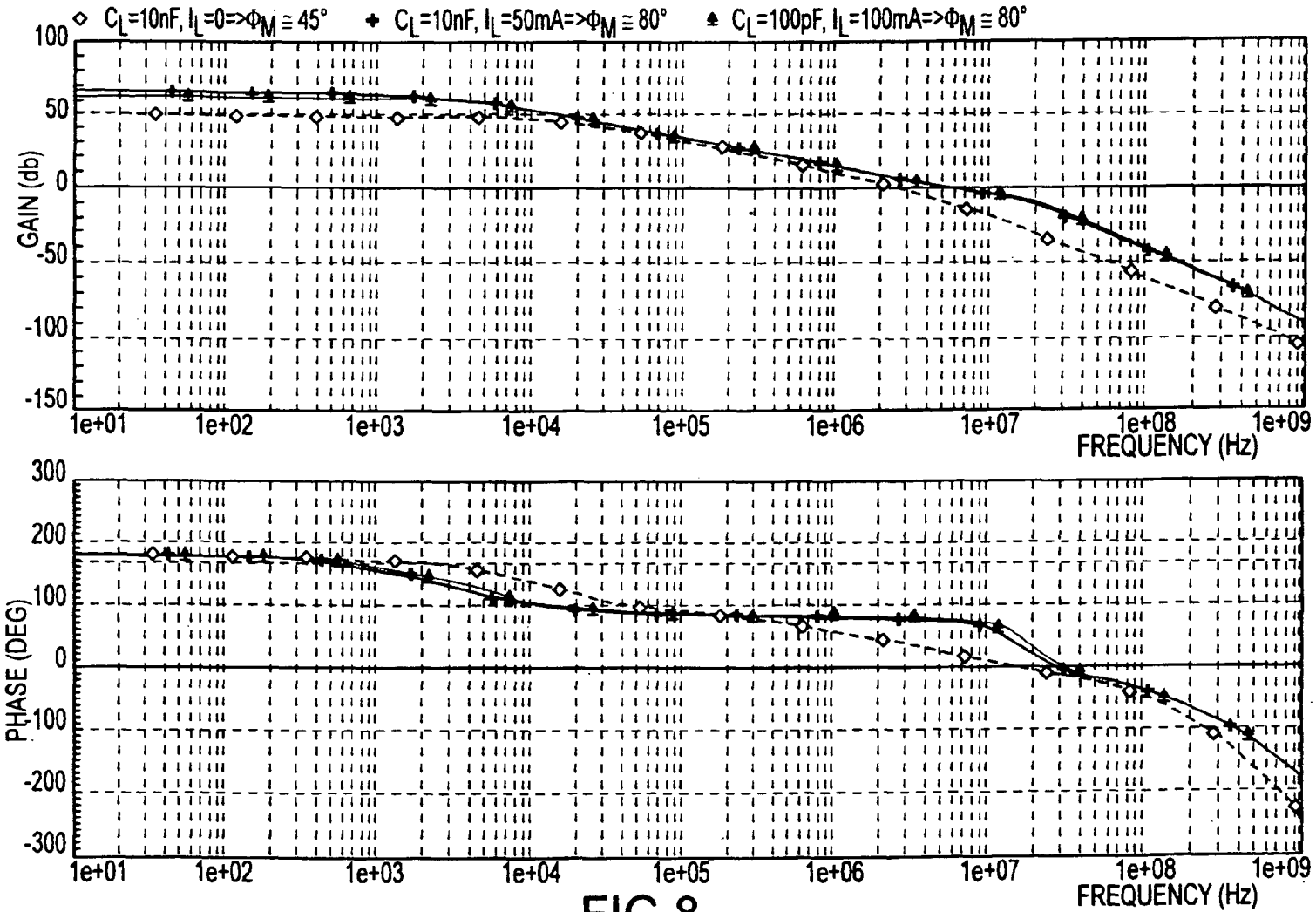
FIG. 8 illustrates the simulated Bode plot of an example LDO according to an embodiment of the present disclosure for a load capacitance of 10 nF.

The simulated bode plots corresponding to the above three cases are shown in FIG. 8. A minimum 45° phase margin is obtained in case 4, which is the worst case according to the previous analysis. All other cases provide good phase margin and result in a more stable system.

Large Signal Transient Analysis:

The transient response in accordance to the present disclosure is determined by how fast a change in the regulated output voltage $v_{out}$ (node OUT) produces a compensating voltage $v_{diffo2}$ (node K2) at the gate of the driver device 421 to hold the regulated output voltage $v_{out}$ in the specified range. The transient response of the present LDO is improved by utilizing the auxiliary transient improvement blocks 403, 404 and 405 as indicated in FIG. 4.

The slew rate of node 448 is enhanced by the Double Ended Cascode Miller compensation circuit (403). The Double Ended Cascode Miller compensation circuit (403) adds two controlled current sources $gm_{mpc} \times v_3$ and $gm_{mnc} \times v_4$ in addition to a controlled current source $gm_{mp4} \times v_2$ provided by operational transconductance amplifier OTA (202) as shown in FIG. 5. The voltages $v_3$ and $v_4$ are directly coupled to $v_{out}$ by coupling capacitors 419 and 420. When $v_{out}$ decreases due to a sudden increase in the load current $I_L$ (446), both $v_3$ and $v_4$ also decrease due to coupling with $v_{out}$. In this process, $\{(gm_{mpc} \times v_3)+(gm_{mnc} \times v_4)\}$ amount of current is drawn out from node DIFFO2 (node K2) after a single transistor delay, which lowers the gate voltage of the driver transistor 421. Hence the current of driver transistor 421 is increased to compensate for the change in $V_{OUT}$. Similarly, when the load current falls suddenly and produces an increase in the output voltage, $\{(gm_{mpc} \times v_3)+(gm_{mnc} \times v_4)\}$ amount of current is injected into node 448 after a single transistor delay. This increases the gate voltage of the driver transistor 421 and hence reduces its current to compensate for the change in $V_{OUT}$. The propagation delay of only two transistors is associated with Double Ended Cascode Miller block in compensating the regulated output voltage during a transient change.

In block 404, the body voltage ($v_b$) of the driver transistor 421 coupled to $v_{out}$ through the coupling capacitor $C_{NW}$, which counterbalances any change in $V_{OUT}$ at the output node OUT through the controlled current ($gmb_D \times v_b$). Hence, the transient loop delay of a single transistor (the driver transistor 421) is associated with compensating any transient change in $V_{OUT}$.

The transient block 405, also associated with the delay of single transistor as the MPSINK (422), produces instant controlled current $gm_{sin\ k} \times (v_{out} - v_{diffo1})$. The block 405 senses any change in the output voltage $v_{out}$ and counteracts the change in $V_{OUT}$.

Figure 9:
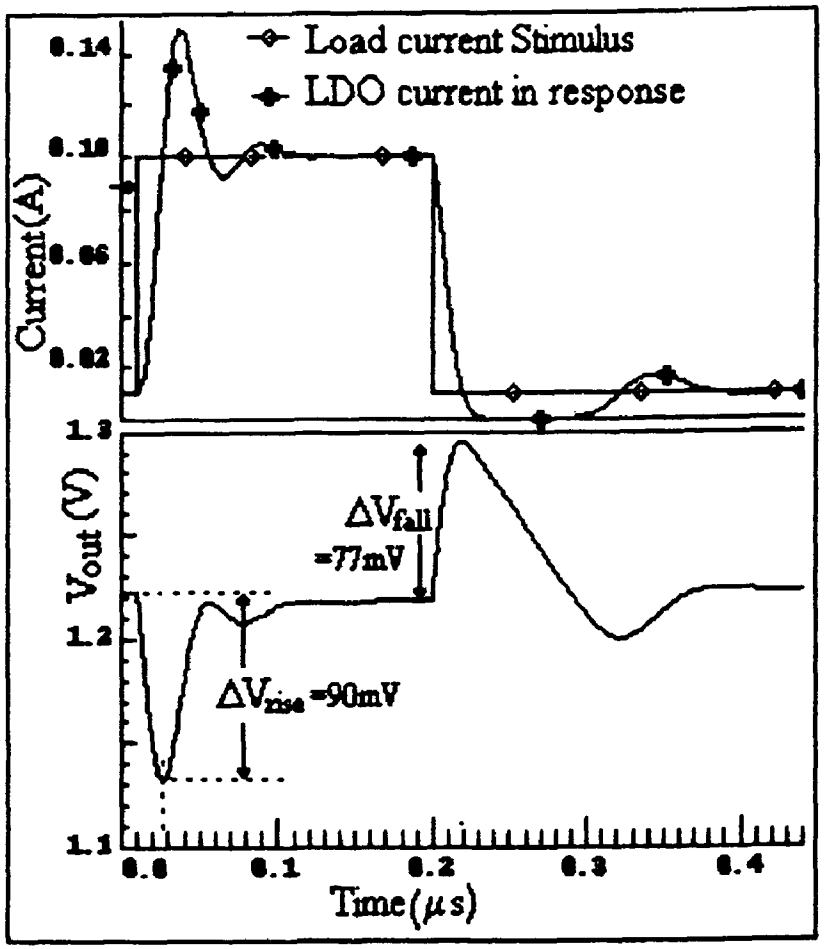
FIG. 9 illustrates the simulated load step response of an example LDO according to an embodiment of the present disclosure for a load capacitance of 10 nF.
Figure 10:
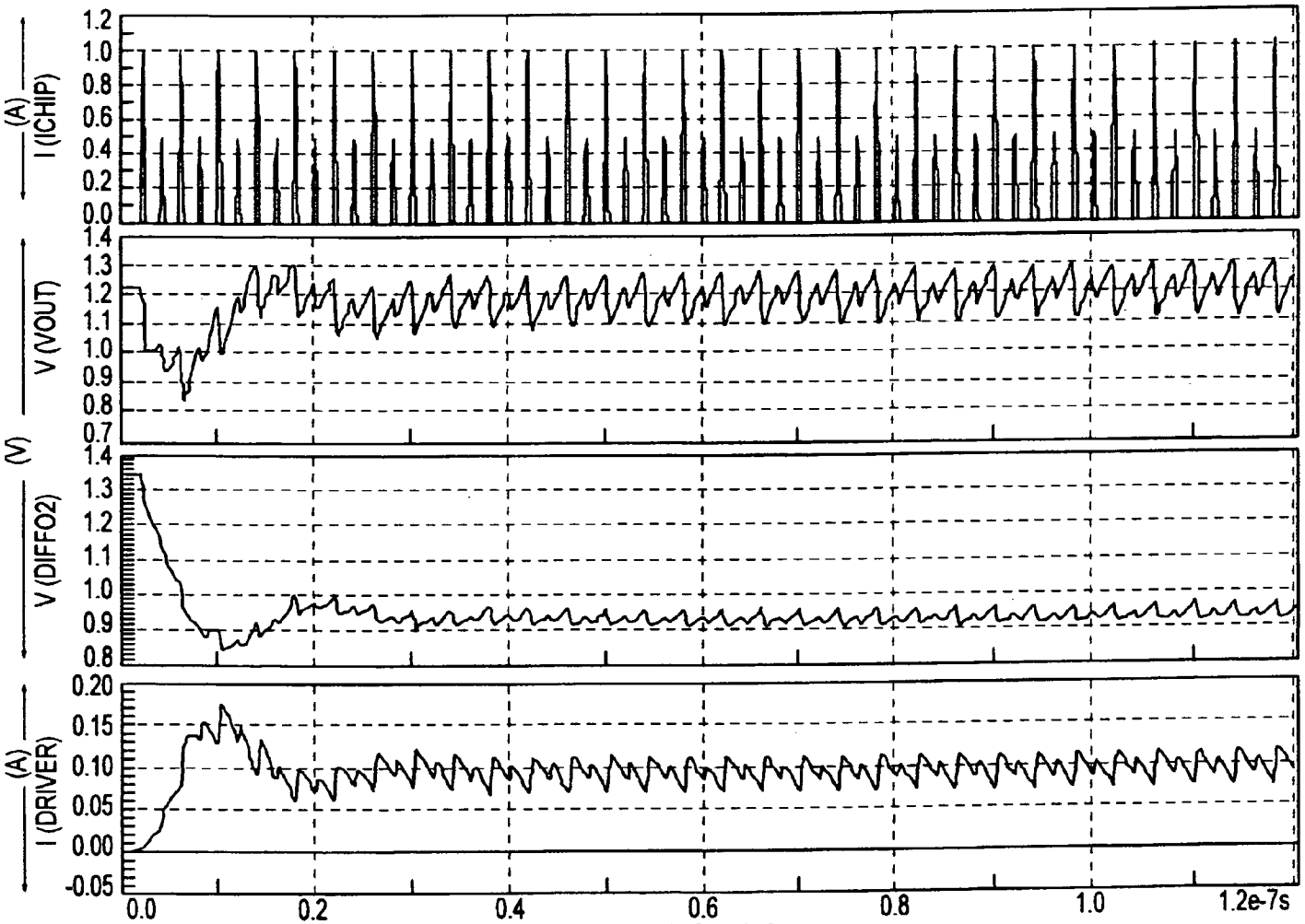
FIG. 10 illustrates the simulated ripple response of the LDO for a train of spike current according to an embodiment of the present disclosure.

Example of Embodiments in Large Signal Transient Analysis According to the Present Disclosure:

By means of the transient enhancement blocks 403, 404 and 405, the response times ($T_R$) of 5 ns and 25 ns are achieved with load capacitances of 1 nF and 10 nF respectively. The transient variation in the regulated output voltage with a step change in the load current and a train of spike currents are shown in the FIGS. 9 and 10 respectively. To provide an average current of 100 mA, a minimum 1 nF on-chip decoupling capacitor with minimum equivalent series resistance (ESR) is provided. The average current produced by a train of spike currents from a digital load circuit as shown in FIG. 10. The value of on-chip decoupling capacitor is reduced when digital load circuits produce spike current with lesser amplitude.

Several embodiments of the present disclosure, relating to a low dropout voltage regulator (LDO), are useful in various applications including system on chip (SoC) devices such as a mobile imaging processor.

The present disclosure utilizes an advanced stability compensation method to achieve a high loop bandwidth and stability of on-chip LDO from no load to full load current and zero to 10 nF load capacitance. Auxiliary transient improvement circuits are utilized to improve the transient response of on-chip LDO and a minimum value of on-chip decoupling capacitor is used with minimal equivalent series resistance (ESR) when the on-chip LDO provides load current to a load composed mainly of digital switching circuitry.

Accordingly, in a preferred embodiment of the present invention, A low dropout voltage regulator (LDO) includes the follow:

- a bias voltage generator 301 producing one or more bias voltages;
- a differential error amplifier 302 having one input receiving a reference voltage $V_{REF}$ and a second input receiving a function of the output voltage $V_{OUT}$ and producing a differential output voltage;
- an output Driver 306 having its input coupled to a first output of said error amplifier 302 and its output terminal providing the output voltage $V_{OUT}$ with its substrate terminal capacitively coupled to the output node OUT and resistively coupled to the input supply node $V_{IN}$;

a controlled active load 305 coupled to the output node OUT and having its control terminal coupled to a function of the second output of said error amplifier 302; and a Double Ended Cascode Miller compensation block 303 having both inputs individually capacitively coupled to the output node OUT and its output coupled to the input of said output Driver 306.

The Double Ended Cascode Miller compensation block preferably comprises the following:

a first PMOS transistor 418 having its source terminal coupled to input supply $V_{IN}$, its gate terminal coupled to a first bias voltage, and its drain terminal connected to a first input node V3;

a second PMOS transistor 417 having its source terminal coupled to the drain terminal of said first PMOS transistor 418, its gate terminal coupled to a second bias voltage, and its drain terminal coupled to its output node K2;

a first NMOS transistor 416 having its source terminal coupled to the common node, its gate terminal coupled to a third bias voltage, and its drain terminal connected to the second input node V4; and a second NMOS transistor 415 having its source terminal coupled to the drain terminal of said first NMOS transistor 416, its gate terminal coupled to a fourth bias voltage, and its drain terminal coupled to said output node K2, the bias voltages being such that the current flowing through both the PMOS transistors and both the NMOS transistors is equal under non-transient conditions.

Preferably, the output driver of the LDO comprises a PMOS transistor 421 operatively coupled between the input supply node $V_{IN}$ and the output node OUT.

Also preferably, the controlled active load comprises a PMOS sink transistor 422 operatively coupled between the output node OUT and the common node.

Although the disclosure of the low dropout voltage regulator (LDO) has been described in connection with various embodiments of the present disclosure illustrated in the accompanying drawings, it is not limited thereto. It will be apparent to those skilled in the art that various substitutions, modifications and changes may be made thereto without departing from the scope and spirit of the disclosure.

I claim:

1. A low dropout voltage regulator (LDO) comprising:

a bias voltage generator producing one or more bias voltages;

a differential error amplifier having one input receiving a reference voltage and a second input receiving a function of the output voltage and producing a differential output voltage;

an output Driver having its input coupled to a first output of said error amplifier and its output terminal providing the output voltage with its substrate terminal capacitively coupled to the output node and resistively coupled to the input supply node;

a controlled active load coupled to the output node and having its control terminal coupled to a function of the second output of said error amplifier; and a Double Ended Cascode Miller compensation block having both inputs individually capacitively coupled to the output node and its output coupled to the input of said output Driver, wherein said controlled active load comprises a PMOS sink transistor operatively coupled between the output node and the common node.

2. The LDO according to claim 1, wherein said Double Ended Cascode Miller compensation block comprises:

a first PMOS transistor having its source terminal coupled to input supply, its gate terminal coupled to a first bias voltage, and its drain terminal connected to a first input node;

a second PMOS transistor having its source terminal coupled to the drain terminal of said first PMOS transistor, its gate terminal coupled to a second bias voltage, and its drain terminal coupled to its output node;

a first NMOS transistor having its source terminal coupled to the common node, its gate terminal coupled to a third bias voltage, and its drain terminal connected to the second input node; and a second NMOS transistor having its source terminal coupled to the drain terminal of said first NMOS transistor, its gate terminal coupled to a fourth bias voltage, and its drain terminal coupled to said output node, wherein the bias voltages is such that the current flowing through both the PMOS transistors and both the NMOS transistors is equal under non-transient conditions.

3. The LDO according to claim 1, wherein said output driver comprises a PMOS transistor operatively coupled between the input supply node and the output node.

4. A system comprising a low dropout voltage regulator (LDO), said regulator comprising:

a bias voltage generator producing one or more bias voltages;

a differential error amplifier having one input receiving a reference voltage and a second input receiving a function of the output voltage and producing a differential output voltage;

an output driver having its input coupled to a first output of said error amplifier and its output terminal providing the output voltage with its substrate terminal capacitively coupled to the output node and resistively coupled to the input supply node;

a controlled active load coupled to the output of said output driver and having its control terminal coupled to a function of the second output of said error amplifier; and a Double Ended Cascode Miller compensation block having both inputs individually capacitively coupled to the output node and its output coupled to the input of said output driver, wherein said controlled active load comprises a PMOS sink transistor operatively coupled between the output node OUT and the common node.

5. The system according to claim 4, wherein said Double Ended Cascode Miller compensation block comprises:

a first PMOS transistor having its source terminal coupled to input supply VIN, its gate terminal coupled to a first bias voltage, and its drain terminal coupled to a first input node;

a second PMOS transistor having its source terminal coupled to the drain terminal of said first PMOS transistor, its gate terminal coupled to a second bias voltage, and its drain terminal coupled to its output node K2;

a first NMOS transistor having its source terminal coupled to the common node, its gate terminal coupled to a third bias voltage, and its drain terminal coupled to the second input node; and a second NMOS transistor having its source terminal coupled to the drain terminal of said first NMOS transistor, its gate terminal coupled to a fourth bias voltage, and its drain terminal coupled to the output node K2, the bias voltages being such that the current flowing through both the PMOS transistors and both the NMOS transistors is equal under non-transient conditions.

6. The system according to claim 4, wherein output driver comprises a PMOS transistor operatively coupled between the input supply voltage and the output node.

7. A mobile imaging processor comprising a low dropout voltage regulator (LDO), said regulator comprising:

a bias voltage generator producing one or more bias voltages;

a differential error amplifier having one input receiving a reference voltage and a second input receiving a function of the output voltage and producing a differential output voltage;

an output driver having its input coupled to a first output of said error amplifier and its output terminal providing the output voltage with its substrate terminal capacitively coupled to the output node and resistively coupled to the input supply node;

a controlled active load coupled to the output of said output driver and having its control terminal coupled to a function of the second output of said error amplifier; and a Double Ended Cascode Miller compensation block having both inputs individually capacitively coupled to the output node and its output coupled to the input of said output driver, wherein said controlled active load comprises a PMOS sink transistor operatively coupled between the output node OUT and the common node.

8. The processor according to claim 7, wherein said Double Ended Cascode Miller compensation block comprises:

a first PMOS transistor having its source terminal coupled to input supply node VIN, its gate terminal coupled to a first bias voltage, and its drain terminal coupled to a first input node;

a second PMOS transistor having its source terminal coupled to the drain terminal of said first PMOS transistor, its gate terminal coupled to a second bias voltage, and its drain terminal coupled to output node K2;

a first NMOS transistor having its source terminal coupled to the ground terminal, its gate terminal coupled to a third bias voltage, and its drain terminal coupled to a second input node; and a second NMOS transistor having its source terminal coupled to the drain terminal of said first NMOS transistor, its gate terminal coupled to a fourth bias voltage, and its drain terminal coupled to the output node K2, the bias voltages being such that the current flowing through both the PMOS and both the NMOS transistor is equal under non-transient conditions.

9. The processor according to claim 7, wherein said output driver comprises a PMOS transistor operatively coupled between the input supply node and the output node.

* * * * *